United States Patent [19]

Larson

[11] Patent Number: 4,748,962

[45] Date of Patent: Jun. 7, 1988

[54] COMPOUND ARCHERY BOWS

[75] Inventor: Marlow W. Larson, Ogden, Utah

[73] Assignee: Browning Arms Company, Morgan, Utah

[21] Appl. No.: 236,781

[22] Filed: Feb. 23, 1981

[51] Int. Cl.[4] ..... F41B 5/00

[52] U.S. Cl. ..... 124/23 R; 124/DIG. 1

[58] Field of Search ..... 124/24 R, 23 R, 86, 124/90, DIG. 25; 242/147 R; 188/65.11

[56] References Cited

U.S. PATENT DOCUMENTS

| | | | |
|---|---|---|---|
| 976,861 | 11/1910 | Firestone | 188/65.1 |
| 3,486,495 | 12/1969 | Allen | 124/24 R |
| 4,064,862 | 12/1977 | Groner | 124/23 R |
| 4,187,826 | 2/1980 | Killian | 124/24 R |
| 4,337,749 | 7/1982 | Barna | 124/24 R |
| 4,338,910 | 7/1982 | Darlington | 124/24 R |

*Primary Examiner*—Richard J. Apley
*Assistant Examiner*—John Welsh
*Attorney, Agent, or Firm*—Trask, Britt & Rossa

[57] ABSTRACT

An eccentric for mounting at the distal end of a limb of a compound archery bow includes a step-down take-up ramp which combines the features of the side-by-side and step-down eccentrics of known eccentrics while maintaining vane clearance and avoiding development of twist on the limb. The eccentric is also provided with a cable clamp device permitting adjustment of the draw of the bow and a pivot insert which permits adjustable pivot locations for the eccentric.

26 Claims, 3 Drawing Sheets

COMPOUND ARCHERY BOWS

BACKGROUND OF THE INVENTION

1. Field

This invention relates to compound archery bows. It is specifically directed to an improved eccentric wheel for such bows.

2. State of the Art

Compound archery bows have been well known for many years. An early patent descriptive of such bows and their mode of operation is U.S. Pat. No. 3,486,495. Such bows are generally characterized by "let-off" leveraging devices carried at the distal ends of the limbs. These leveraging devices are usually referred to as wheels or pulleys, although they may take various forms, including some with other than circular cross-sections. They are commonly referred to as "eccentrics," because they characteristically are pivoted around an axle located off center with respect to their perimeters.

The eccentrics carried at the tips of opposite limbs are interconnected by cables and a bow string. Although various arrangements are possible, a typical arrangement includes two cables, each of which is anchored at some point on a limb and stretched accross the handle, around at least a portion of the perimeter of the eccentric carried by the opposite limb. The free ends of the cables are fastened to respective opposite ends of a string, sometimes referred to as a "central stretch". Lengths of cable are thus positioned between the string and the handle of the bow. It is important that the string be positioned with respect to the cabling (at least at fired condition), to provide adequate vane clearance. Vane clearance between the string and cables must be sufficient to avoid interference by the cables with an arrow launched by the bow. Such clearance has been provided in various ways. Sometimes, especially when narrow eccentrics are used, structures (cable guards) are carried by the handle or limbs of the bow to hold the cables out away from the plane of the string in the vicinity of the handle. In other instances, wide eccentrics are used, and the cables are located to one side of the eccentrics while the string is located at the other side of the eccentrics so that they are spaced as they cross the handle.

A common problem associated with compound bows (because of the necessity from maintaining vane clearance) is the buildup of torque in the bow limbs as the string is pulled back to full draw position. This torque results from the relatively large buildup of force in the cable system of the bow compared to that of the string. These forces are translated to the axle of the eccentric. They oppose each other in that they are translated to opposite sides of the midpoint of the axis, but they do not balance each other. As a consequence, the axis tends to rotate, thereby tending to twist the bow limb. That is, a bending movement is imparted to the limbs of the bow. A recent innovation has been to provide a spiraled groove on the eccentric so that as the string is pulled to full draw position, and the eccentric pivots, the wound cable migrates across the pulley to near the central location of the string. The force of the cable system is thus applied close to the midpoint of the axle, thereby reducing the bending moment of the limbs at full draw. When an arrow is launched and the string moves toward the handle of the bow, the eccentric pivots back to its static position, and the spiraled groove carries the cable back out to the edge of the pulley.

Eccentrics have been produced in various configurations to achieve certain special characteristics. For example, "side-by-side" pulleys have separate grooves to accommodate the "string" end of the cable and the "take-up" end of the cable. The cable passes through the interior of the pulley to gain access to both grooves. "Side-by-side" pulleys locate the string and cable forces at set distances on opposite sides of the midpoint of the axle. In this way the bending moment at full draw may be fixed within a known limit, while maintaining vane clearance. The limbs may then be strengthened on one side to compensate for the remaining bending moment imparted to the axle at full draw of the bow. Thic eccentric style developes relatively high speed compared to another popular type, the "step-down" pulley. "Step-down" eccentrics have a "take-up" groove of smaller diameter than the diameter of the string groove. In effect they provide a lower "gear ratio" which reduces the force developed in the cable at full draw. This reduced force effects a correspondingly reduced bending moment at the limb.

Because of the bending moments developed in the limbs at full draw, it has heretofore been necessary to provide different structural members to serve as upper and lower limbs, respectively. If an upper limb were substituted for a lower limb, the structural expedients incorporated to resist the bending moment of the upper limb would be exactly the reverse of what was required for the lower limb.

Heretofore, adjusting the draw weight or eccentric characteristics of a compound archery bow has been relatively burdensome. Some bows have come equipped with interchangeable pulleys of different diameters or having axle journals located various distances from the center. The methods used for anchoring cables internal the eccentrics have not lent themselves to ready adjustment. The anchoring mechanism has generally been destructive of the cable so that reanchoring of the cable pulled through the eccentric to a different location has not been feasible.

SUMMARY OF THE INVENTION

The present invention provides a number of improvements to the eccentrics for a compound bow. Ideally, the improved eccentric of this invention is embodied as a wheel of approximately circular cross-section normal its axis, incorporating an improved cable lock system, a unique pivot bearing insert, and a novel step-down take-up cable ramp. Each of these improved features is independently significant, and may be incorporated in eccentrics of various configurations which do not incorporate the other improvements of this invention. Nevertheless, each of these features contributes to the oveall advantage and improved performance of a compound bow when they are incorporated together in the eccentrics of the bow in accordance with the preferred embodiments of this invention.

The cable lock system of this invention provides a means for positively clamping the segment of the cable normally passed through the interior of the eccentric; e.g., through a cable bore running diagonally from groove to groove through the midpoint of a "side-by-side" pulley. As presently envisioned, a threaded bore is provided in communication with the cable bore. The threaded bore is desirably provided with a keyway. A pair of locking elements with mutually opposed locking faces, adapted cooperatively to grip a cable, are inserted from respective sides of the threaded bore. These elements include keys to maintain appropriate registration of the locking faces with the cable bore, and are pressed into engagement with opposite side of a cable within the cable bore. They may be locked in place by means of threaded studs. By adjusting each of the locking elements to press the cable without distorting it, the cable damage commonly experienced with the locking devices of the prior art is avoided. Moreover, it is practical to release the pressure on the locking devices to reposition the cable within the bore. This system thus provides a convenient means to adjust the draw weight of the bow by merely loosening the cable, pivoting the eccentric to a desired "static" orientation, and then reclamping the cable. The locking elements are ideally configurated as nominally hemispherical cable clamps which are forced into impingement on the cable with set screws. This locking system is ideally suited to relatively wide eccentrics such as the "side-by-side" and "step-down" types.

The pivot bearing insert of this invention provides a means for rapidly adjusting the pivot location of the eccentric with respect to its perimeter and its center. The pivot bearing is of any convenient geometrical cross-sectional shape permitting registration in a plurality of alternative rotated positions within a similarly shaped channel provided transverse the eccentric approximately parallel its axis. As presently envisioned, the pivot bearing is configurated as a prism (usually somewhat tapered along its length) with a regular polygonal cross-section; e.g., a hexagon, pentagon, or more commonly a rectangle. A bore is provided through the prism parallel but removed from its central axis to function as the axle journal for the eccentric. The eccentric is provided with a bearing hole (channel) parallel its central axis at any desired location, (usually, in the case of a wheel, on a diameter but removed from the center of the wheel). The hole is configurated to receive the pivot bearing in a press fit relationship. Thus, the precise location of the axle journal will depend upon which of several possible orientations is selected for the pivot bearing within the bearing hole. When it is desired to alter the location of the axle (the pivot point for the eccentric) the pivot bearing may be pressed from the eccentric and reoriented, thereby moving the axle journal with respect to the perimeter and center of the eccentric.

The step-down take-up ramp feature of this invention combines the desirable features of a side-by-side pulley system and a step-down pulley system. It also significantly reduces the bending moment of the bow limbs at full draw while providing for adequate vane clearance when an arrow is launched. When the bow is at static or undrawn condition, the draw string is taut and pulls on the pulley or eccentric with more force than is applied by the cable wound on the take-up side of the eccentric. In that position, the string or stretch end of the cable is positioned in a groove at one side of the eccentric and the take-up end of the cable is positioned within a groove on the opposite side of the eccentric, thereby maintaining any differential in forces within tolerable limits; that is, any resulting bending moment is of low magnitude, and does not materially affect the limb. As the eccentric pivots in response to pulling on the bow string, the wound end of the cable is cammed from its static rest position down a ramp towards the center of the eccentric, thereby carrying the force plane of the cable towards the center of the axle. As the cable travels down the ramp, the effective diameter of the eccentric decreases. Thus, the eccentric assumes the characteristics of a step-down pulley with a reduced ratio at full draw. At full draw, the forces in the cables are at their maximums, and it is a significant advantage for those forces to be applied near the centers of the axles. When an arrow is launched, the wound cable unwinds moving the wound end up the ramp, thereby increasing the ratio of the eccentric. The speed of the arrow is thus increased, as in the case of a side-by-side eccentric.

A common cable arrangement has each of the cables anchored at one end to the axle of an eccentric on the side opposite the string groove. Each cable then runs to the other eccentric, on which it is wound, ultimately connecting to one end of the string. Preferably, the string groove is located with respect to the midpoint of the axle such that its force at full draw opposes and approximately balances the force applied by the anchor end of the opposite cable. The forces referred to in this disclosure are torque forces, which when balanced, effect a diminimus bending (twisting) moment to a limb. When an arrow is nocked and the string is brought to full draw, adequate vane clearance remains between the string and the cables, and the bending moment resulting from the string, the anchored end of the opposite cable and the wound end of the proximate cable is approximately zero. Accordingly, the limbs need not be reinforced at either side, and upper and lower limbs may be made interchangeable.

The eccentrics of this invention may be configurated to function at both the upper limb and the lower limb, but it is presently preferred to use separate configurations for the two limbs. The step-down take-up ramp for the eccentric of the lower limbs is reversed in direction to that of the eccentric of the upper limbs.

BRIEF DESCRIPTION OF THE DRAWINGS

In the drawings, which illustrate what is presently regarded as the best mode for carrying out the invention.

DESCRIPTION OF THE ILLUSTRATED EMBODIMENTS

Figure 1:
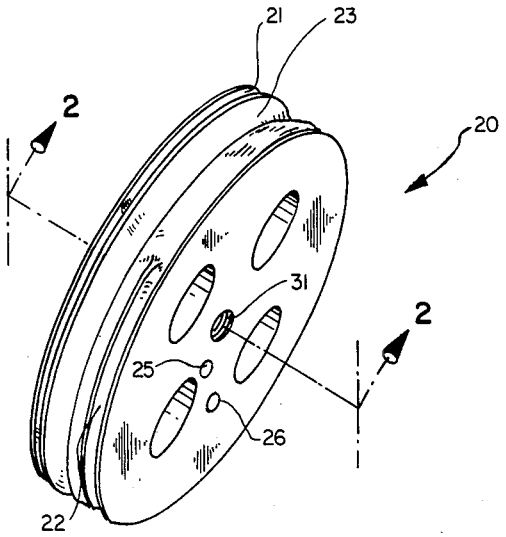
FIG. 1 is a pictorial view of one embodiment of an eccentric wheel of this invention.
Figure 2:
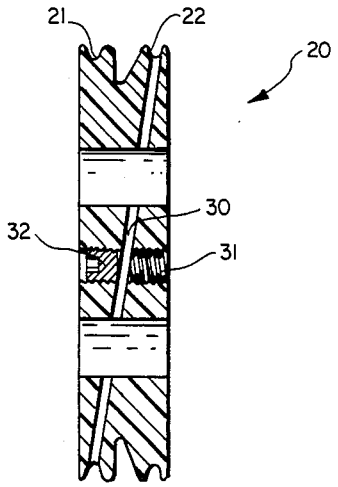
FIG. 2 is a view in cross-section taken along the line 2—2 of FIG. 1.

The eccentric wheel 20 of FIGS. 1 through 4 is relatively wide, typically approximately ¾ inch, and is of the "side-by-side" type. That is, it carries a string groove 21 at one edge and a take-up groove 22 at its opposite edge. The draw side groove 22 merge into a ramp 23 which functions to cam the cable lying in that groove either towards the center or the edge of the wheel 20 depending upon the direction of rotation of the wheel 20, as will be explained in more detail with reference to FIGS. 3 and 4. The specific eccentric 20 illustrated is for the upper limb. A corresponding eccentric for the lower limb is similar in all essential details, but the ramp 23 is configurated to wind and unwind in directions opposite those of the illustrated eccentric 20. This disclosure is directed to the upper eccentric 20 illustrated to avoid redundancy.

As illustrated, the wheel 20 includes a pair of journals 25, 26 from which the wheel 20 may selectively be mounted to a hanger structure 27 carried by the distal end of the limb 28 by means of an axle bolt 29. The grooves 21, 22 are connected by an interior bore 30 which runs diagonally through the wheel 20, as shown, usually along a diameter (in the illustrated case, the section plane). Thus, a cable (not shown) strung through the bore 30 passes through the threaded hole 31 at approximately the center of the wheel 20. The cable can thus be locked into place by turning set screw 32 until it kinks the cable into the intersection between the bores 30 and 31.

Figure 3:
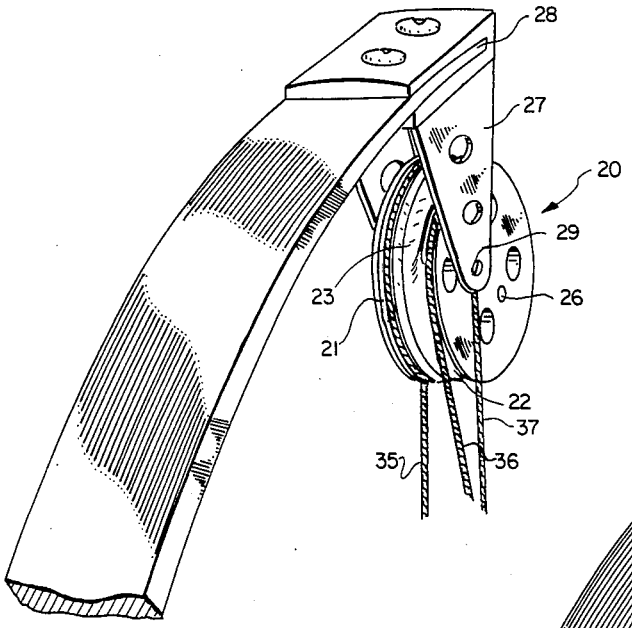
FIG. 3 is a view of a portion of a compound bow limb with the eccentric of FIG. 1 mounted to its distal end shown in static condition.
Figure 4:
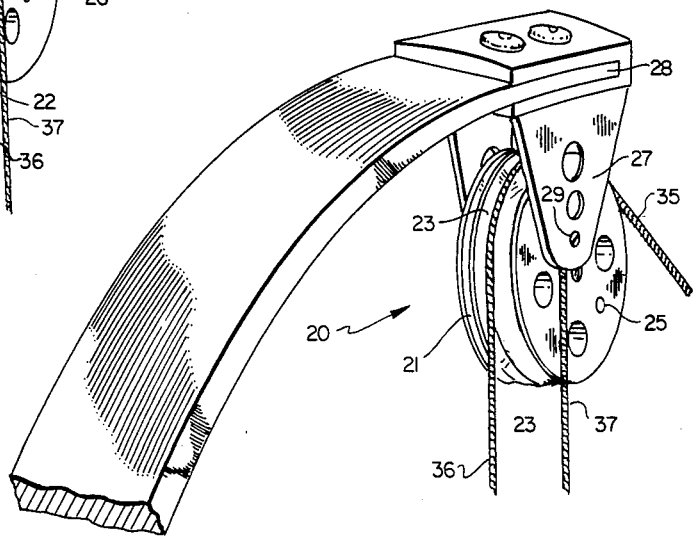
FIG. 4 is a view similar to FIG. 3 but showing the limb and eccentric in full draw condition.
Figure 5:
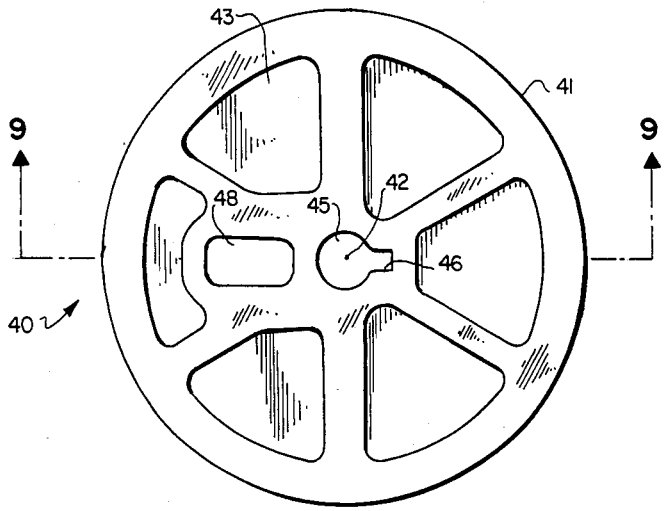
FIG. 5 is a view in elevation of one side of an alternative embodiment of the eccentric of this invention incorporating the removable pivot bearing and cable lock features of this invention.
Figure 7:
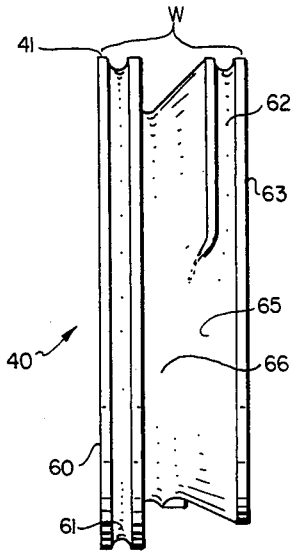
FIG. 7 is a view in elevation of the eccentric illustrated by FIG. 5 rotated 90° on an axis vertical with respect to FIG. 5.
Figure 6:
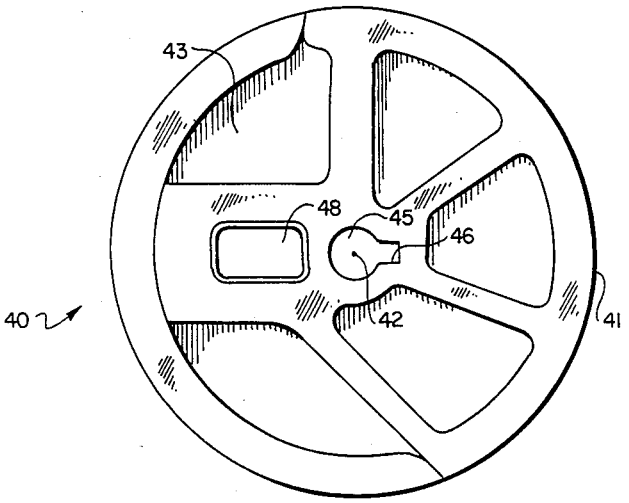
FIG. 6 is a view in elevation of the opposite side of the eccentric of FIG. 5.
Figure 8:
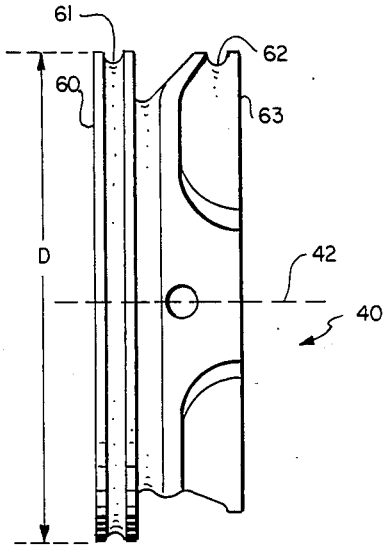
FIG. 8 is a view in elevation of the eccentric of FIG. 5 rotated 180° with respect to FIG. 7.
Figure 9:
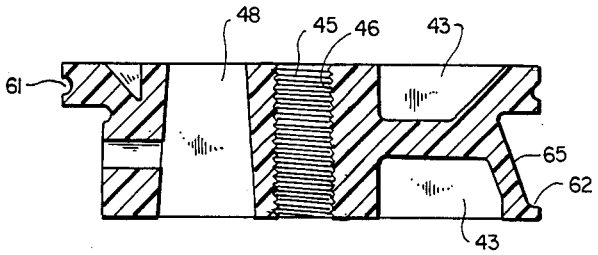
FIG. 9 is a view in cross-section taken along the line 9—9 of FIG. 5.

As best shown by FIG. 3, in the at rest (static) condition, the eccentric 20 is positioned so that the strung end 35 of the cable is contained by the groove 21 at one side of the eccentric 20 and the wound end 36 of the cable is contained by the groove 22 at the opposite side of the eccentric 20. The anchored end 37 of the other cable of the system is attached to the axle bolt 29 opposite the string groove 21. In this position, the forces applied by the two cable ends 36, 37 approximately balance the force applied by the string end 35. FIG. 4 shows the eccentric 20 pivoted at full draw so that the wound end 36 has cammed down the ramp 23. In this position, the force applied by the wound end 36 is much increased, but is applied near the midpoint of the axle 29. The torque resulting from the strung end 35 approximately balances the torque resulting from the anchored end 37. The vane clearance remains adequate, (in the illustrated instance, approximately ½ inch). The ratio developed through the eccentric in FIG. 4 is less than the corresponding ratio in FIG. 3.

A highly preferred embodiment of this invention is illustrated by FIGS. 5 through 9, which show an eccentric wheel member 40. This wheel 40 is also relatively wide W, typically ¾ inch or more, across its perimeter 41 parallel its center axis 42, and may be of any practical diameter D, typically about 2 to about 3 inches. It is preferably produced from lightweight material such as aluminum alloy or plastic, and is provided with regions 43 of reduced cross-section to limits its weight. A tapped hole 45 extends entirely through the wheel 40 at its center 42. A keyway 46 communicates with the hole 45 as shown.

Figure 10:
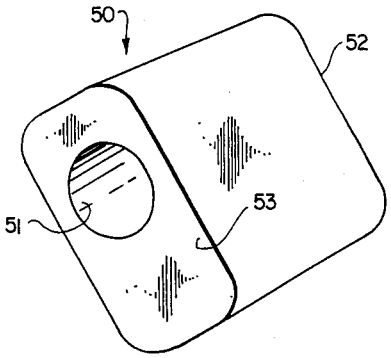
FIG. 10 is a pictorial view of a pivot bearing for use with the eccentric illustrated by FIGS. 5 through 9.

A second hole 48 of ractangular cross-section is provided through the wheel 40 approximately parallel its center axis 42 and radially positioned between the center 42 and perimeter 41. This hole 48 is slightly larger in cross section at one side (FIG. 6) than at its other (FIG. 5), and is thereby adapted to receive the tapered pivot bearing 50 of FIG. 10 in a press fit to interference fit relationship.

Figure 11:
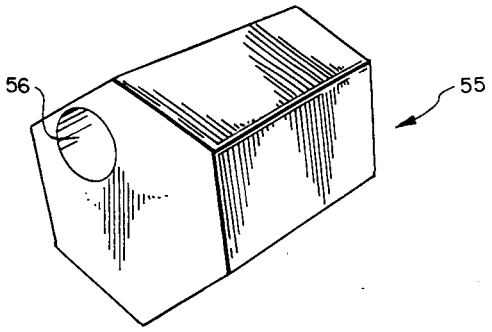
FIG. 11 is a pictorial view of an alternative form of pivot bearing.

The hole 48 illustrated will accommodate the pivot bearing 50 in either of two orientations, thereby offering a choice of either of two locations for the axle journal 51. The end 52 is larger than the end 53 in correspondence with the taper of the hole 48 best shown by FIG. 9. This hole 48 may take other configurations; e.g., to receive the pivot bearing 55 shown by FIG. 11. This bearing element offers an even greater selection of locations for the axle journal 56.

One edge 60 of the wheel 40 carries a groove 61 which extends around the entire perimeter 41 of the wheel 40. This groove accommodates the strung end of one of the cables of a compound bow as explained in connection with the embodiment of FIGS. 1–4. A second groove 52 is carried at the other edge 63 of the wheel 40. This groove 62 accommodates the take-up end of the same cable, and functions to hold the cable near the edge 63 of the wheel 40 when the bow is in its static condition. The ramp 65 functions as previously explained to cam the cable over and down to the valley 66 as the eccentric 40 pivots on its axle (through journal 51) to full draw condition.

Figure 12:
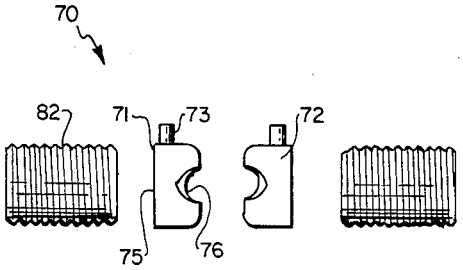
FIG. 12 is an exploded pictorial view of components of the cable lock system of this invention.
Figure 13:
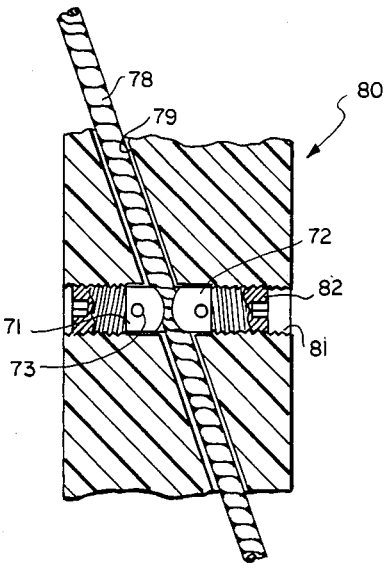
FIG. 13 is a fragmentary view partially in section of an eccentric illustrating the cable lock components of FIG. 12 in place to clamp a cable.

Referring to FIGS. 12 and 13, a cable clamp assembly 70 of this invention includes a pair 71, 72 of clamp members, each of which has a key element 73, a relatively flat pressure surface 75, and a cable groove 76. FIG. 13 shows the assembly of FIG. 12 rotated approximately 90° so that the keys 73 project out toward the viewer. The keys 73 register with a keyway (not shown, see FIGS. 5 and 6), bringing the groove 76 in registration with a cable 78 strung through a bore 79 in an eccentric 80. The bore 79 communicates with a threaded hole 81. The clamp members 71, 72 are pressed into engagement with cable 78 by set screws 82 turned through opposite ends of the hole 81. The clamp members 71, 72 are preferably made from a hard, resilient material, such as Nylon, which can be pressed firmly against the cable 78 without causing damage. Ideally, the members 71, 72 are advanced approximately the same distance through the hole 81 to avoid kinking the cable 78.

It is within contemplation that the valley 66 be coplaner with the take-up groove 62 and the ramped surface 65. For example, the take-up groove may be made progressively deeper or the diameter of the eccentric carrying the take-up groove may be made continuously smaller in the direction of wind. In either event, the ratio at full draw will be relatively low, and will increase substantially when the eccentric returns to static condition. A bow may be constructed so that the torque forces on the limbs are either approximately balanced or are within tolerable limits at full draw, even though the cable is cammed only downward, and not also toward the midpoint of the axle. It is also within contemplation that the cable may be severed and segments of the cable separately attached to the eccentric to train in the string groove and take-up groove, respectively. Such segments are sill considered parts of a single cable within the context of this disclosure and the appended claims.

Reference herein to details of the illustrated embodiments is not intended to limit the scope of the appended claims which themselves recite those details regarded as essential to the invention.

I claim:

1. In a compound bow including a handle, a pair of limbs extending from opposite ends of the handle, a pair of eccentrics carried by the respective distal ends of said limbs and a pair of cables, each anchored at one end to a respective limb and wrapped around the eccentric carried by the opposite limb to provide a wound end and strung end connected to a bow string, an improved eccentric, comprising:

a member adapted for mounting by an axle through an axle journal in said member to a said limb;

a first groove near a first edge of said member to receive said strung end of said cable;

a second groove near the opposite edge of said member to receive said wound end of the same said cable;

a valley of smaller diameter than said second groove disposed between said first and second grooves; and a ramped surface extending from said valley and merging with said second groove so that as said member pivots on said axle to wind said wound end, the cable following said wound end is cammed down and laterally towards said first groove into said valley.

2. An improvement according to claim 1 wherein said valley is approximately at the midpoint of said axle journal so that at full draw of said bow, the force applied by the cable in said valley effects approximately no torque to the limb carrying said eccentric.

3. An improvement according to claim 1 including a channel interior said member connecting said first and second grooves, whereby to string a cable between said grooves; a bore in communication with said channel connecting said grooves; a cable disposed in said channel; and a pair of cable clamp elements disposed within said bore, one on each side of said cable; and means for urging said cable clamp elements into engagement with said cable, thereby to secure said cable without creating a kink therein.

4. An improvement according to claim 3 wherein said bore includes a keyway, and said clamp elements include keys to register with said keyway, thereby to hold the clamping surfaces of said clamp elements in a prescribed orientation.

5. An improvement according to claim 4 wherein the clamping faces of said cable clamp elements include grooves adapted to said cable.

6. An improvement according to claim 3 wherein said bore extends entirely through said eccentric transverse a diameter.

7. An improvement according to claim 6 wherein said bore is threaded, and said means for urging said clamps into engagement with said cable comprise threaded studs.

8. An improvement according to claim 7 wherein said bore is at the center axis of said eccentric.

9. An improvement according to claim 7 wherein said bore includes a keyway, and said clamp elements include keys to register with said keyway, thereby to hold the clamping surfaces of said clamp elements in a prescribed orientation.

10. An improvement according to claim 9 wherein the clamping faces of said cable clamp elements include grooves adapted to said cable.

11. An improvement according to claim 1 including a bearing hole through said eccentric approximately parallel its center axis, said bearing hole containing in press fit relationship a removable pivot bearing element which includes an axle journal.

12. An improvement according to claim 11 wherein said pivot bearing is configurated approximately as a prism of regular geometric cross-section so that it may be positioned in said bearing hole in a plurality of rotated positions and said axle journal is parallel but removed from the central axis of said prism.

13. An improvement according to claim 12 wherein the cross-sectional configuration of said prism is approximately rectangular, and said prism is slightly tapered so that its cross-sectional area at one end is larger than at its other end.

14. An improvement according to claim 3 including a bearing hole through said eccentric approximately parallel its center axis, said bearing hole containing in press fit relationship a removable pivot bearing element which includes an axle journal.

15. An improvement according to claim 14 wherein said pivot bearing is configurated approximately as a prism of regular geometric cross-section so that it may be positioned in said bearing hole in a plurality of rotated positions, and said axle journal is parallel but removed from the central axis of said prism.

16. An improvement according to claim 15 wherein the cross-sectional configuration of said prism is approximately rectangular, and said prism is slightly tapered so that its cross-sectional area at one end is larger than at its other end.

17. An improvement according to claim 17 including a bearing hole through said eccentric approximately parallel its center axis, said bearing hole containing in press fit relationship a removable pivot bearing element which includes an axle journal.

18. An improvement according to claim 17 wherein said pivot bearing is configurated approximately as a prism of regular geometric cross-section so that it may be positioned in said bearing hole in a plurality of rotated positions, and said axle journal is parallel but removed from the central axis of said prism.

19. An improvement according to claim 18 wherein the cross-sectional configuration of said prism is approximately rectangular, and said prism is slightly tapered so that its cross-sectional area at one end is larger than at its other end.

20. In a compound archery bow including a handle, a pair of limbs extending from opposite ends of the handle, a pair of eccentrics mounted on axles at the respective distal ends of said limbs and a pair of cables, each anchored at one end to a respective limb and wrapped around the eccentric mounted at the opposite limb to provide a wound end and a strung end, said strung ends being connected to opposite ends of a bow string so that as the bow string is pulled away from its rest position near the handle through an intermediate peak drawn position towards the fully drawn condition of the bow, the eccentrics pivot on their respective axles to permit unwinding of the strung ends of the cables from the eccentrics and winding of additional cable following said wound ends onto said eccentrics, the improvement comprising:

providing a non-circular winding track in each of said eccentrics to receive respective said wound ends of said cables, said tracks being configurated so that as said bow string is pulled to wind additional cable following said wound ends onto said eccentrics, the portions of said tracks receiving cable are located progressively closer to the axles of said eccentrics, thereby reducing the effective diameters of said tracks at the drawn condition of the bow; and providing a track of different configuration than said winding track for unwinding said strung ends.

21. An improvement according to claim 20 wherein each eccentric includes a string track near a first edge of said eccentric and said winding track is near the opposite edge of said eccentric at rest position.

22. An improvement according to claim 21 wherein said string track is non-concentric with respect to said axle.

23. An improvement according to claim 22 wherein said string track is a first groove in the perimeter of said eccentric and said winding track is a second groove in the perimeter of said eccentric, said tracks being constructed and arranged so that the ratio of the effective diameter of the string track to the effective diameter of the winding track increases as the string is pulled from peak draw to fully drawn condition.

24. In a compound archery bow including a handle, a pair of limbs extending from opposite ends of the handle, a pair of eccentrics mounted on axles at the respective distal ends of said limbs and a pair of cables, each anchored at one end to a respective limb and wrapped around the eccentric mounted at the opposite limb to provide a wound end and a strung end, said strung ends being connected to opposite ends of a bow string so that as the bow string is pulled away from its rest position near the handle through an intermediate peak drawn position towards the fully drawn condition of the bow, the eccentrics pivot on their respective axles to permit unwinding of the strung ends of the cables from the eccentrics and winding of additional cable following said wound ends onto said eccentrics, the improvement comprising:

providing a non-circular winding track in each of said eccentrics to receive respective said wound ends of said cables, said track each including a spool surface adapted to take up additional cable following said wound ends as said bow string is pulled, said spool surface being structured and arranged such that as the bow string is pulled the point of contact between the spool surface and the cable entering the winding track shifts progressively towards the axles of the eccentrics; and providing an unwinding track of different configuration than said winding track for unwinding the said strung ends.

25. An improvement according to claim 24 wherein each eccentric includes said unwinding track near a first edge of said eccentric and said winding track commences near the opposite edge of said eccentric and spirals laterally towards said unwinding track and downwardly towards said axle.

26. An improvement according to claim 25 wherein said winding and unwinding treacks are constructed and arranged so that the ratio of the effective diameter of the unwinding track to the effective diameter of the winding track increases as the string is pulled from peak to fully drawn conditions.

* * * * *

US004748962B1

REEXAMINATION CERTIFICATE (2202nd)

United States Patent [19]

Larson

[11] B1 4,748,962

[45] Certificate Issued Jan. 25, 1994

[54] COMPOUND ARCHERY BOWS

[75] Inventor: Marlow W. Larson, Ogden, Utah

[73] Assignee: Browning Arms Company, Morgan, Utah

Reexamination Request:
No. 90/002,480, Oct. 17, 1991

Reexamination Certificate for:

| | |
|---|---|
| Patent No.: | 4,748,962 |
| Issued: | Jun. 7, 1988 |
| Appl. No.: | 236,781 |
| Filed: | Feb. 23, 1981 |

[51] Int. Cl.[5] ..... F41B 5/10
[52] U.S. Cl. ..... 124/25.6; 124/900
[58] Field of Search ..... 124/25.6, 900, 23.1, 124/24.1, 86, 88, 90; 242/147 R

[56] References Cited

U.S. PATENT DOCUMENTS

| | | | |
|---|---|---|---|
| 976,861 | 11/1910 | Firestone . | |
| 3,486,495 | 12/1969 | Allen | 124/25.6 |
| 4,187,826 | 2/1980 | Killian | 124/25.6 |
| 4,338,910 | 7/1982 | Darlington | 124/25.6 |

*Primary Examiner*—Randolph A. Reese

[57] ABSTRACT

An eccentric for mounting at the distal end of a limb of a compound archery bow includes a step-down take-up ramp which combines the features of the side-by-side and step-down eccentrics of known eccentrics while maintaining vane clearance and avoiding development of twist on the limb. The eccentric is also provided with a cable clamp device permitting adjustment of the draw of the bow and a pivot insert which permits adjustable pivot locations for the eccentric.

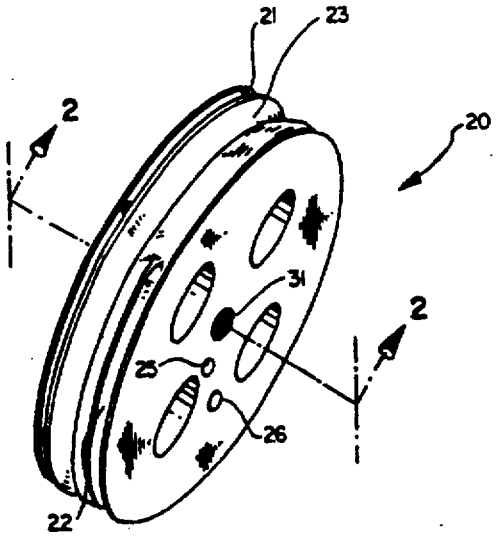

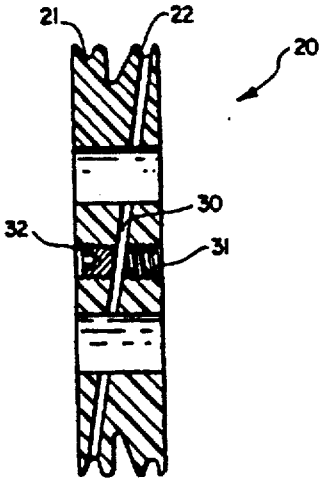

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-16 and 25-26 is confirmed.

Claims 20-24 are cancelled.

Claim 17 is determined to be patentable as amended.

Claims 18 & 19, dependent on an amended claim, are determined to be patentable.

New claims 27-33 are added and determined to be patentable.

17. An improvement according to claim [17] *7* including a bearing hole through said eccentric approximately parallel its center axis, said bearing hole containing in press fit relationship a removable pivot bearing element which includes an axle journal.

*27. In a compound archery bow including a handle, a pair of limbs extending from opposite ends of the handle, a pair of eccentrics mounted on axles at the respective distal ends of said limbs and a pair of cables, each anchored at one end to a respective limb and wrapped around the eccentric mounted at the opposite limb to provide a wound end and a strung end, said strung ends being connected to opposite ends of a bow string so that as the bow string is pulled away from its rest position near the handle through an intermediate peak drawn position towards the fully drawn condition of the bow, the eccentrics pivot on their respective axles to permit unwinding of the strung ends of the cables from the eccentrics and winding of additional cable following said wound ends onto said eccentrics, the improvement comprising:*

*providing a non-circular winding track in each of said eccentrics to receive respective said wound ends of said cables, said tracks being configured so that as said bow string is pulled to wind additional cable following said wound ends on to said eccentrics, the portions of said tracks receiving cable are located progressively closer to the axles of said eccentrics, thereby reducing the effective diameters of said tracks at the drawn condition of the bow; and*

*providing a track of different configuration than said winding track for unwinding said strung ends;*

*whereby said winding track spirals downwardly away from said unwinding track towards said axle.*

*28. An improvement according to claim 27 wherein each eccentric includes a string track near the first edge of said eccentric and said winding track is near the opposite edge of said eccentric at rest position.*

*29. An improvement according to claim 28 wherein said string track is non-concentric with respect to said axle.*

*30. An improvement according to claim 29 wherein said string track is a first groove in the perimeter of said eccentric and said winding track is a second groove in the perimeter of said eccentric, said tracks being constructed and arranged so that the ratio of the effective diameter of the string track to the effective diameter of the winding track increases as the string is pulled from peak draw to fully drawn condition.*

*31. In a compound archery bow including a handle, a pair of limbs extending from opposite ends of the handle, a pair of eccentrics mounted on axles at the respective distal ends of said limbs and a pair of cables, each anchored at one end to a respective limb and wrapped around the eccentric mounted at the opposite limb to provide a wound end and a strung end, said strung ends being connected to opposite ends of a bow string so that as the bow string is pulled away from its rest position near the handle through an intermediate peak drawn position towards the fully drawn condition of the bow, the eccentrics pivot on their respective axles to permit unwinding of the strung ends of the cables from the eccentrics and winding of additional cable following said wound ends onto said eccentrics, the improvement comprising:*

*providing a non-circular winding track in each of said eccentrics to receive respective said wound ends of said cables, said tracks each including a spool surface adapted to take up additional cable following said wound ends as said bow string is pulled, said spool surface being structured and arranged such that as the bow string is pulled the point of contact between the spool surface and the cable entering the winding track shifts progressively towards the axles of the eccentrics; and*

*providing an unwinding track of different configuration than said winding track for unwinding the said strung ends;*

*whereby said winding track spirals downwardly away from said unwinding track towards said axle.*

*32. An improvement according to claim 31 wherein each eccentric includes said unwinding track near a first edge of said eccentric and said winding track commences near the opposite edge of said eccentric and spirals downwardly away from said unwinding track towards said axle.*

*33. An improvement according to claim 32 wherein said winding and unwinding tracks are constructed and arranged so that the ratio of the effective diameter of the unwinding track to the effective diameter of the winding track increases as the string is pulled from peak to fully drawn conditions.*

* * * * *

US004748962B1

REEXAMINATION CERTIFICATE (2817th)

United States Patent [19] [11] B1 4,748,962

Larson [45] Certificate Issued Mar. 19, 1996

[54] COMPOUND ARCHERY BOWS

[75] Inventor: Marlow W. Larson, Ogden, Utah

[73] Assignee: Browning Arms Company, Morgan, Utah

Reexamination Request:
No. 90/002,480, Oct. 17, 1991

Reexamination Certificate for:

| | |
|---|---|
| Patent No.: | **4,748,962** |
| Issued: | **Jun. 7, 1988** |
| Appl. No.: | **236,781** |
| Filed: | **Feb. 23, 1981** |

[51] Int. Cl.[6] ..... F41B 5/10
[52] U.S. Cl. ..... 124/25.6; 124/900
[58] Field of Search ..... 124/25.6, 900, 124/23.1, 24.1, 86, 88, 90; 242/147 R

[56] References Cited

U.S. PATENT DOCUMENTS

| | | | |
|---|---|---|---|
| 976,861 | 11/1910 | Firestone . | |
| 3,486,495 | 12/1969 | Allen | 124/25.6 |
| 4,187,826 | 2/1980 | Killian | 124/25.6 |
| 4,338,910 | 7/1982 | Darlington | 124/25.6 |

*Primary Examiner*—Kenneth T. Dorner

[57] ABSTRACT

An eccentric for mounting at the distal end of a limb of a compound archery bow includes a step-down take-up ramp which combines the features of the side-by-side and step-down eccentrics of known eccentrics while maintaining vane clearance and avoiding development of twist on the limb. The eccentric is also provided with a cable clamp device permitting adjustment of the draw of the bow and a pivot insert which permits adjustable pivot locations for the eccentric.

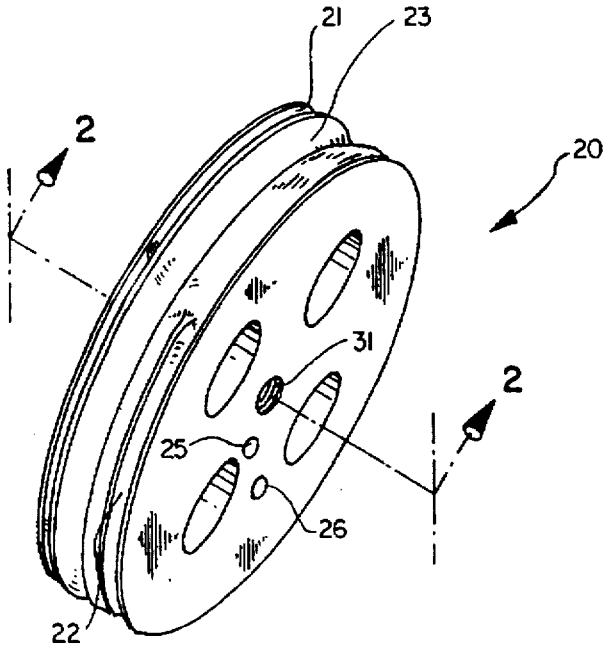

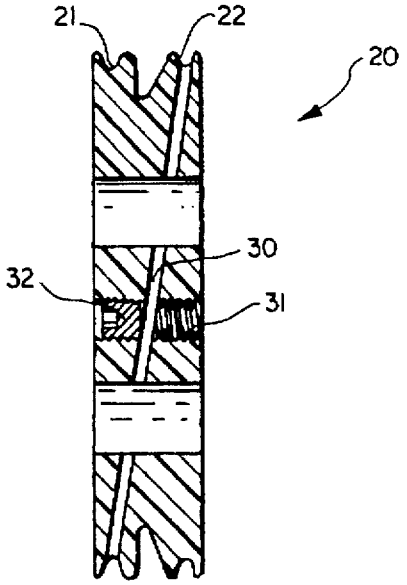

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–16 and 25–26 is confirmed.

Claims 20–24 are cancelled.

Claim 17 is determined to be patentable as amended.

Claims 18 –19 dependent on an amended claim, are determined to be patentable.

New claims 27–40 are added and determined to be patentable.

17. An improvement according to claim [17] *7* including a bearing hole through said eccentric approximately parallel its center axis, said bearing hole containing in press fit relationship a removable pivot bearing element which includes an axle journal.

*27. In a compound archery bow including a handle, a pair of limbs extending from opposite ends of the handle, a pair of eccentrics mounted on axles at the respective distal ends of said limbs and a pair of cables, each anchored at one end to a respective limb and wrapped around the eccentric mounted at the opposite limb to provide a wound end and a strung end, said strung ends being connected to opposite ends of a bow string so that as the bow string is pulled away from its rest position near the handle through an intermediate peak drawn position towards the fully drawn condition of the bow, the eccentrics pivot on their respective axles to permit unwinding of the strung ends of the cables from the eccentrics and winding of additional cable following said wound ends onto said eccentrics, the improvement comprising:*

*providing a non-circular winding track in each of said eccentrics to receive respective said wound ends of said cables, said tracks being configured so that as said bow string is pulled to wind additional cable following said wound ends on to said eccentrics, the portions of said tracks receiving cable are located progressively closer to the axles of said eccentrics, thereby reducing the effective diameters of said tracks at the drawn condition of the bow; and*

*providing a track both of different configuration and longer than said winding track for unwinding said strung ends.*

*28. An improvement according to claim 27 wherein each eccentric includes a string track near the first edge of said eccentric and said winding track is near the opposite edge of said eccentric at rest position.*

*29. An improvement according to claim 28 wherein said string track is non-concentric with respect to said axle.*

*30. An improvement according to claim 29 wherein said string track is a first groove in the perimeter of said eccentric and said winding track is a second groove in the perimeter of said eccentric, said tracks being constructed and arranged so that the ratio of the effective diameter of the string track to the effective diameter of the winding track increases as the string is pulled from peak draw to fully drawn condition.*

*31. In a compound archery bow including a handle, a pair of limbs extending from opposite ends of the handle, a pair of eccentrics mounted on axles at the respective distal ends of said limbs and a pair of cables, each anchored at one end to a respective limb and wrapped around the eccentric mounted at the opposite limb to provide a wound end and a strung end, said strung ends being connected to opposite ends of a bow string so that as the bow string is pulled away from its rest position near the handle through an intermediate peak drawn position towards the fully drawn condition of the bow, the eccentrics pivot on their respective axles to permit unwinding of the strung ends of the cables from the eccentrics and winding of additional cable following said wound ends onto said eccentrics, the improvement comprising:*

*providing a non-circular winding track in each of said eccentrics to receive respective said wound ends of said cables, said tracks each including a spool surface adapted to take up additional cable following said wound ends as said bow string is pulled, said spool surface being structured and arranged such that as the bow string is pulled the point of contact between the spool surface and the cable entering the winding track shifts progressively towards the axles of the eccentrics; and*

*providing an unwinding track of both different configuration and greater length than said winding track for unwinding the said strung ends.*

*32. An improvement according to claim 31 wherein each eccentric includes said unwinding track near a first edge of said eccentric and said winding track commences near the opposite edge of said eccentric and spirals downwardly away from said unwinding track towards said axle.*

*33. An improvement according to claim 32 wherein said winding and unwinding tracks are constructed and arranged so that the ratio of the effective diameter of the unwinding track to the effective diameter of the winding track increases as the string is pulled from peak to fully drawn conditions.*

*34. In a compound archery bow including a handle, a pair of limbs extending from opposite ends of the handle, a pair of eccentrics mounted on axles at the respective distal ends of said limbs and a pair of cables, each anchored at one end to a respective limb and wrapped around the eccentric mounted at the opposite limb to provide a wound end and a strung end, said strung ends being connected to opposite ends of a bow string so that as the bow string is pulled away from its rest position near the handle through an intermediate peak drawn position towards the fully drawn condition of the bow, the eccentric pivot on their respective axles to permit unwinding of the strung ends of the cables from the eccentrics and winding of additional cable following said wound ends onto said eccentrics, the improvement comprising:*

*providing a non-circular winding track in each of said eccentrics to receive respective said wound ends of said cables, said tracks being configured so that as said bow string is pulled to wind additional cable following said wound ends on to said eccentrics, the portions of said tracks receiving cable are located progressively closer to the axles of said eccentrics, thereby reducing the effective diameters of said tracks at the drawn condition of the bow; and*

*providing a track of different configuration than said winding track for unwinding said strung ends; whereby said winding track spirals downwardly away from said unwinding track towards said axle.*

*35. An improvement according to claim 34 wherein each eccentric includes a string track near the first edge of said eccentric and said winding track is near the opposite edge of said eccentric at rest position.*

*36. An improvement according to claim 35 wherein said string track is non-concentric with respect to said axle.*

*37. An improvement according to claim 36 wherein said string track is a first groove in the perimeter of said eccentric and said winding track is a second groove in the perimeter of said eccentric, said tracks being constructed and arranged so that the ratio of the effective diameter of the string track to the effective diameter of the winding track increases as the string is pulled from peak draw to fully drawn condition.*

*38. In a compound archery bow including a handle, a pair of limbs extending from opposite ends of the handle, a pairof eccentrics mounted on axles at the respective distal ends of said limbs and a pair of cables, each anchored at one end to a respective limb and wrapped around the eccentric mounted at the opposite limb to provide a wound end and a strung end, said strung ends beng connected to opposite ends of a bow string so that as the bow string is pulled away from its rest position near the handle through an intermediate peak drawn position towards the fully drawn condition of the bow, the eccentrics pivot on their respective axles to permit unwinding of the strung ends of the cables from the eccentrics and winding of additonal cable following said wound ends onto said eccentrics, the improvement comprising:*

*providing a non-circular winding track in each of said eccentrics to receive respective said wound ends of said cables, said tracks each including a spool surface adapted to take up additional cable following said wound ends as said bow string is pulled, said spool surface being structured and arranged such that as the bow string is pulled the point of contact between the spool surface and the cable entering the winding track shifts progressively towards the axles of the eccentrics; and*

*providing an unwinding track of different configuration than said winding track for unwinding the said strung ends; whereby said winding track spirals downwardly away from said unwinding track towards said axle.*

*39. An improvement according to claim 38 wherein each eccentric includes said unwinding track near a first edge of said eccentric and said winding track commences near the opposite edge of said eccentric and spirals downwardly away from said unwinding track towards said axle.*

*40. An improvement according to claim 39 wherein said winding and unwinding tracks are constructed and arranged so that the ratio of the effective diameter of the unwinding track to the effective diameter of the winding track increases as the string is pulled from peak to fully drawn conditions.*

* * * * *